US005293861A

United States Patent [19]

Mandeville et al.

[11] Patent Number: 5,293,861

[45] Date of Patent: Mar. 15, 1994

[54] DIRECT CONTACT WATER HEATER WITH HYBRID HEAT SOURCE

[75] Inventors: Luc Mandeville, Terrebonne; Michel Dallaire, St-Bruno-De-Mon, both of Canada

[73] Assignees: Sofame Inc.; Gas Metropolitain, both of Montreal, Canada

[21] Appl. No.: 32,279

[22] Filed: Mar. 17, 1993

[30] Foreign Application Priority Data

Jan. 25, 1993 [CA] Canada ..... 2088018

[51] Int. Cl.[5] ..... F24H 1/10

[52] U.S. Cl. ..... 126/355; 126/359

[58] Field of Search ..... 126/355, 359, 360 R, 126/360 A, 350 R; 122/28, 31.1

[56] References Cited

U.S. PATENT DOCUMENTS

| | | | |
|---|---|---|---|
| 884,223 | 4/1908 | Shipley | 126/359 |
| 4,574,775 | 3/1986 | Lutzen et al. | 122/28 |
| 4,686,940 | 8/1987 | Fullemann | 122/28 |
| 4,895,136 | 1/1990 | Poppe | 126/359 |

*Primary Examiner*—James C. Yeung

*Attorney, Agent, or Firm*—Oblon, Spivak, McClelland, Maier & Neustadt

[57] ABSTRACT

A direct contact water heater having a hybrid heat source, and its method of operation is described. The water heater is comprised of an elongated vertical tubular housing having a water spray nozzle in an upper end thereof for spraying water substantially uniformly over a top packing of heat exchange bodies. An intermediate space is provided below the packing where external hot recovery gases are admitted into the housing. A burner chamber is provided at the bottom of the housing above a reservoir to provide a primary heat source. Heat from the primary heat source mixes with the hot recovery gases below the packing, and is in counter-current flow with the water percolating through the housing from the packing located at the top of the housing. Two packings of heat exchange bodies may be provided in the tubular housing spaced from one another with the hot recovery gases fed between the two packings and the primary hot gas from the heat source being generated below a lower one of the packings.

15 Claims, 2 Drawing Sheets

DIRECT CONTACT WATER HEATER WITH HYBRID HEAT SOURCE

TECHNICAL FIELD

The present invention relates to a direct contact water heater column having a hybrid heat source and particularly, but not exclusively, to a column having two spaced apart packings of heat exchange bodies and wherein external hot recovery gases are injected into the housing between the packings and a primary heat source is located in the housing below the lower one of the packings.

BACKGROUND ART

Direct contact water heaters are known, such as described in U.S. Pat. No. 4,574,775 issued on Mar. 11, 1986 and comprised of a vertically oriented cylindrical column having a packing adjacent an upper end thereof. Water to be heated is sprayed on top of the packing so that the water is heated by the packing and also by hot gases passing through the cylindrical column. The hot gases are usually provided by a fossil fuel burner which is installed at the bottom of the column to produce hot flue gases which are directed upwardly in counter-current flow to water droplets falling from the packing. The energy of the flue gas is absorbed by the down-coming water droplets and these droplets are further heated when entering into direct contact with the flame. Hot water is stored at the bottom of the column from where it is pumped to supply external devices.

Direct contact flue gas stack economizers operate substantially as direct contact water heaters with the exception that the hot flue gases are generated from other sources. Flue gases from those other sources are admitted into the column below the packing and the energy of the flue gases is absorbed by the down-coming water. Although these stack economizers are considered to be an efficient way of recovering lost heat, they have two main disadvantages, one being that the maximum outlet temperature of the column is approximately the dew point temperature of the flue gases entering the column. Also, the maximum amount of energy which can be transferred to the water depends, and is limited by, the actual flue gas flow and temperature available from existing external apparatus, and this can vary at different time intervals. Therefore, an additional amount of heat may be needed in order to supplement the recovered heat to meet the process demand. This additional amount of heat may be added by a direct contact water heater or by other means. It must be kept in mind, however, that the disadvantages of direct contact stack economizers are compensated by the big advantage of free energy from the existing flue gas recovered from other sources which was previously lost to the atmosphere.

The direct contact water heaters do not have the same outlet water temperature limitation as does the direct contact stack economizer, and can heat water well above the dew point of the combustion gases. Also, the direct contact water heater can be sized for any amount of energy required, as it has its own burner. However, one of the disadvantages of the conventional direct contact water heater is that it heats water at a very high efficiency level with fossil fuel, but this fossil fuel is costly as compared to free energy being recovered by direct contact economizers. Also, the temperature of the flue gases being exhausted by the direct contact water heater is equal or slightly higher than the incoming water. In the case of water being preheated by a direct contact stack economizer, and where a direct contact water heater would be subsequently utilized to add the additional energy required, the flue gases exhausting from the heater would still be hot enough that it would be economical to channel them into the direct contact stack economizer for further cooling down of the exhaust gases. Accordingly, there is a waste of energy.

There is therefore a need to provide an ideal water heater arrangement wherein cold water is introduced at the top of a direct contact stack economizer and is preheated by hot flue gases. Preheated water at the bottom of the direct contact stack economizer would then be transferred to the top of a direct contact water heater to be further heated. Flue gas exhausting from the direct contact water heater would then be directed to the direct contact stack economizer to be cooled down as much as possible. These flue gases would combine with flue gases of other apparatus. However, the main disadvantage of this arrangement would be the cost of fabricating and interconnecting two separate pieces of equipment, namely a direct contact stack economizer and a direct contact water heater.

SUMMARY OF INVENTION

It is a feature of the present invention to provide a direct contact water heater having a hybrid heat source which substantially overcomes the above-mentioned disadvantages of the prior art discussed above.

Another feature of the present invention is to provide a direct contact water heater having a hybrid heat source which combines the advantages of the direct contact flue gas stack economizer with the advantages of the direct contact water heater in a single column housing.

Another feature of the present invention is to provide a direct contact water heater having a hybrid heat source and wherein the column may be provided with a single packing or two spaced-apart packings.

Another feature of the present invention is to provide a direct contact water heater having a hybrid heat source and which provides the combined advantages of recovering hot exhaust gases from auxiliary devices, heating water to a desired level and in an appropriate quantity using the direct contact method, and cooling combined flue gases as much as possible.

According to the above features, from a broad aspect, the present invention provides a direct contact water heater having a hybrid heat source. The water heater comprises an elongated vertical tubular housing having a water spray nozzle in an upper end thereof for spraying water downwardly on a top packing of heat exchange bodies held in a region of the housing by support means. An exhaust flue gas is connected to the upper end of the housing. An intermediate space is provided in the housing below the top packing. A hot recovery gas inlet is provided in a wall of the housing and communicates with the intermediate space to admit a flow of secondary heat in the housing. A burner chamber is provided below the hot gas inlet. A burner is connected to the burner chamber for generating a flame in the burner chamber to form a primary heat source, and together with the secondary heat constituting the hybrid heat source. The water sprayed on the top packing is firstly heated by hot gases from the hybrid heat source rising from the top packing, and then is further heated by the heat exchange bodies where water propagates and falls in droplets by gravity from a lower surface of the packing. The droplets falling from the lower surface of the packing are still further heated by contact with rising heat below the top packing and flame in the combustion chamber. The heated water accumulates in a lower reservoir where it is transferred by a pump circuit connected thereto.

According to a still further broad aspect of the present invention there is provided a method of heating water in a direct contact water heater column and which comprises providing a packing of heat exchange bodies across an inner space of the column in a top portion thereof. Water is sprayed substantially uniformly over a top one of the packings so that water percolates in droplets down into the inner space of the column to a lower reservoir. Heat is generated in the column to rise therealong and exits at the top end of the column. The heat is displaced in counter-current to the percolating water droplets and heats the exchange bodies of the packings. Heated water from the lower reservoir is then pumped through an outlet line. The heat generated in the column is from a hybrid heat source which is comprised of a primary heat source and recovery heat from external sources admitted in the housing.

According to a still further broad aspect of the present invention, the apparatus and method utilize two spaced-apart packings in the columns with the hot gases from an outside recovery heat source being fed between the packings and the primary heat being generated by a burner secured in a burner housing below a lower one of the packings. The primary and the outside recovery heat source is mixed in an intermediate chamber defined between the packings to form the hybrid heat source which propagates through the top one of the packings, and heats water droplets falling through the intermediate chamber.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
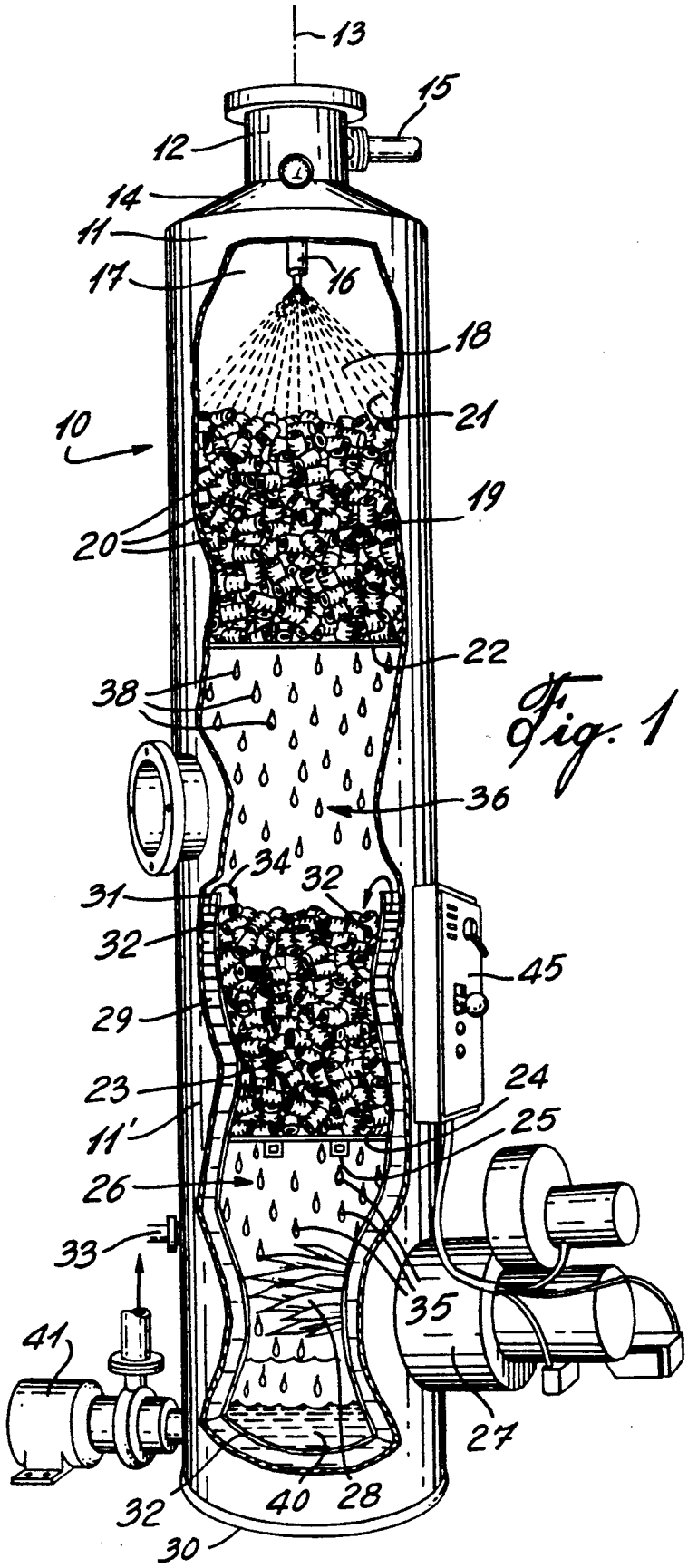
FIG. 1 is a fragmented side view of the direct contact water heater of the present invention incorporating a hybrid heat source.

Referring now to the drawings, and more particularly to FIG. 1, there is shown generally at 10 the direct contact water heater of the present invention. The water heater comprises a vertically disposed tubular housing 11 formed from any suitable metal material capable of withstanding the heat propagated through the column defined by the tubular housing 11. The column has an exhaust gas flue 12 generally centrally disposed with respect to the central longitudinal axis 13 of the housing in a top wall 14 thereof. Side outlets may also be used. A water inlet feed pipe 15 is connected to the top wall 14 to supply a source of water to a water spray nozzle 16 located in a top end 17 of the housing on the axis 13. The water spray nozzle faces downwardly to directly a spray 18 of water substantially uniformly over a top packing 19 of heat exchange bodies 20. As herein shown, the heat exchange bodies are small hollow cylindrical bodies, or alternatively they could be perforated elements having different shapes. The packing 19 is supported across the inner circumferential wall 21 of the housing 11 by support means, herein constituted by a stainless steel screen 22.

Spaced below the top packing a predetermined distance is a lower packing 23 also having heat exchange bodies 20 supported over a metal screen 24. The metal screen is supported on hollow tubular support bars 25. Below the lower packing 23 is defined a combustion chamber 26 wherein a burner 27 is connected thereto to generate a flame 28 within the chamber and for contact with water falling in the chamber.

As can be seen, a cooling hollow circumferential chamber 29 is defined between the bottom outer wall section 11' of the burner housing 11 and a tubular casing 32 disposed inside the tubular housing 11 and spaced from the side wall section 11'. The circumferential chamber 29 has a circumferential open top end 31 which terminates above the lower packing 23. The chamber 29 defines an annular cooling jacket between the tubular casing 32 and the tubular housing wall 11' and the bottom wall of the housing 11. A cooling water inlet 33 is connected to the chamber 29 for feeding cooling water thereinto and circulating same in the chamber and causing overflow, as shown at 34 from the open top end 31 and onto the lower packing 23. As the water from this overflow propagates through the heat exchange bodies, it is broken down to droplets 35 or split flows, is heated and fall from the lower surface of the lower packing 23 supported on the metal screen 24.

The hollow tubular bars 25 extend across the tubular casing 32 and have a hollow through bore therein which communicates with the annular cooling chamber 29 whereby cooling water will also flow through the hollow through bores of the support bars to also cool these bars due to their close contact with the flame 28. The metal screen 24 is also treated to resist the high heat of the flame 28.

The area between the top packing 19 and the lower packing 23 constitutes an intermediate space 36 and to which a hot recovery gas inlet coupling 37 is connected. Hot recovery gases from other heat sources are admitted into this intermediate section where this hot recovery gas mixes with the primary hot gas generated by the flame 28 which rises through the column. The mixture of these gases takes place in this intermediate section and constitutes a hybrid heat source for the column. This mixture of heat further heats the water droplets 38 which fall from the lower end of the top packing 19 and also heats the heat exchange bodies in the top packing.

It can therefore be seen that with the direct contact water heater of the present invention, cold water is introduced through the water inlet feed pipe 15 and is distributed substantially uniformly over the top packing 19 by the water spray nozzle 16 located thereover. Cold water from the water line is also introduced by the coupling inlet 33 into the annular cooling chamber 29 around the burner chamber 26. Hot flue gases from other sources are introduced under pressure into the intermediate space or section 36 of the housing through the inlet flue 37. The pressure, positive or negative, is sufficient to cause a rising draft in the column or chamber and prevent return heat flow through the breaching 49 (see FIG. 3) connected thereto. A flame is generated in the combustion chamber by the burner 27 which mixes and burns fossil fuel with oxygen, either pure oxygen or oxygen contained in the ambient air.

The incoming cold water sprayed by the nozzle 16 is first heated by direct contact of the droplets from the spray with the flue gases coming up and out of the top packing 19. This occurs in the upper portion of the tubular housing 11 above the top packing. This is the first step of heating the water and the last step in cooling the combined flue gases before they are exhausted through the flue 12. The water then percolates through the top packing 19 and substantially all streams of water which tend to form are broken down into droplets by the shape of the heat exchange bodies 20 in the packing. These heat exchange bodies also provides an appropriate time of contact between the combined flue gases and the down-coming water to cool down the gases and heat the water. This is the second step of heating the water and the second and last stage of cooling the combined flue gases.

Water droplets 38 then fall from the top packing 19 into the intermediate space 36 where they continue to be heated by direct contact with flue gases coming from the inlet 37 and from the burner flame 28 in the burner chamber 26. It is in this intermediate section that the two sources of flue gases mix to form the hybrid heat source. It is also in this intermediate space that water from the annular cooling chamber 29 overflows onto the lower packing 23, and this water mixes with the water droplets 38.

The combined heated water propagates through the bottom packing 23 where the same phenomenon described for the top packing occurs, except that in the lower packing water is heated by the hot flue gases discharged by the burner only. Again, the flue gases from the burner are cooled down and their energy heats the water. This represents the fourth step of heating the water through the column and the second step in cooling the flue gases from the burner.

The water droplets 35 falling by gravity from the bottom of the lower packing 23 enter the combustion chamber 26 where it comes into direct contact with the flame 28 and its surrounding hot flue gases. The hot flue gases are cooled down by direct contact with the water droplets 35 and any water stream that could propagate through the bottom packing, particularly along the inner surface of the circumferential wall 39 due to the overflow 34. This represents the fifth and last step of heating the water and the first step of cooling the burner flame and flue gases. The hot water then falls into the reservoir 40 at the bottom of the tubular casing 32 from where it is transferred by gravity or by a pump 41 to a suitable device or distribution system, as will be described later with respect to FIG. 3.

The flue gases from the burner and the hot recovery gases are mixed in the intermediate section and mechanically forced toward the top of the unit where they are exhausted through the flue 12 after being cooled to a minimum temperature thereby achieving a maximum efficiency for the water heater. The hottest flue gases are produced at the bottom of the unit in the burner housing 26. The median temperature flue gases are the hot recovery gases introduced in the intermediate chamber, and the combined flue gases therefrom are directed toward the exhaust flue and through the top packing. This counter-current gas and water flow provides maximum efficiency.

Figure 2:
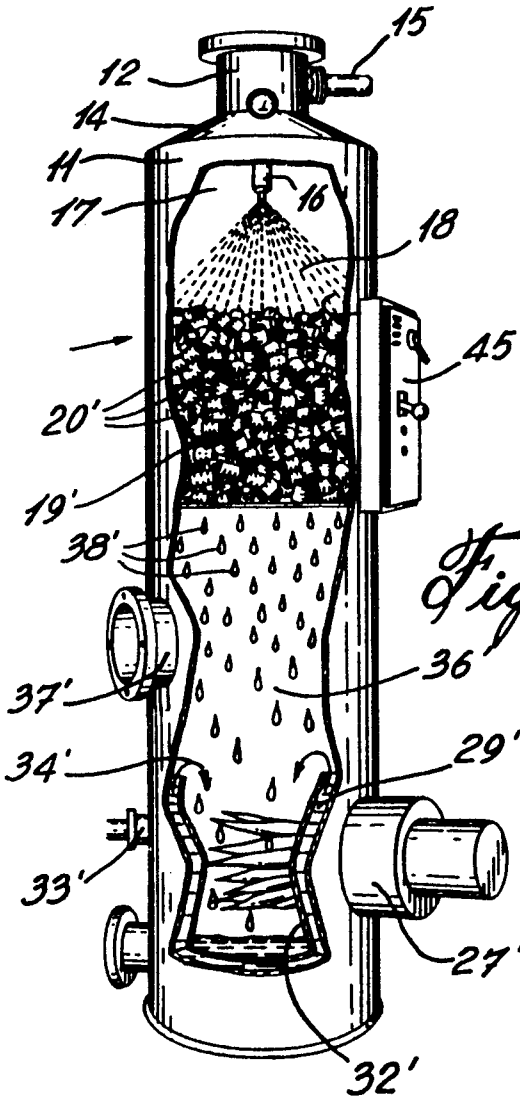
FIG. 2 is a side view similar to FIG. 1 but showing the direct contact water heater having a hybrid heat source with a single packing.

Referring now to FIG. 2, there is shown a modified version of the direct contact water heater wherein only a single top packing 19' is provided. The intermediate space or chamber 36' is of a longer dimension and the hot recovery gases are admitted therein through the inlet flue 37'. It is in this chamber that both hot recovery gases and the primary hot gases from the burner 27' mix and propagate upwards to heat the water droplets 38' within the intermediate chamber and the heat exchange bodies 20' in the packing. As shown in both FIGS. 1 and 2, a control panel 45 and 45' control the operation of the burner and the detailed construction thereof will not be described, as it is obvious to a person skilled in the art. However, in the embodiment of FIG. 2, it is important to control the flame temperature of the burner to ensure proper and continued functioning.

Figure 3:
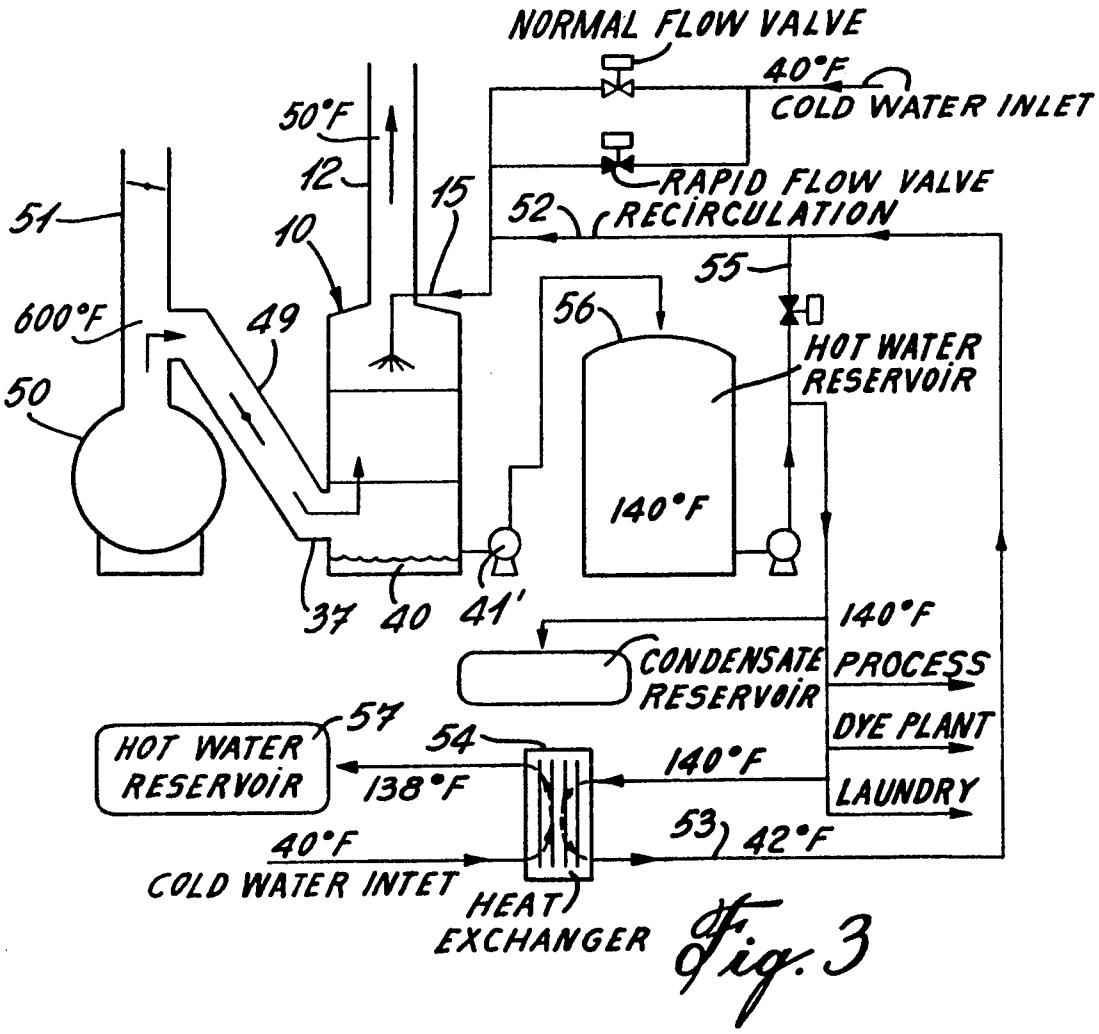
FIG. 3 is a schematic diagram showing the direct contact water heater of the present invention connected in a system where recovery heat is fed to the direct contact water heater and the heated water and supply water is connected in a distribution circuit.

FIG. 3 illustrates the direct contact water heater 10 of the present invention as used in an installational application, i.e., hospital, school, etc. As herein shown, the hot flue gases from the boiler 50 are tapped from the flue 51 thereof and connected to the inlet connection 37 of the water heater 10. The water in the spray nozzle feed pipe 15 is introduced in the heater 11 via spray nozzle 16. The hot water tank 56 is fed hot water by the pump 41 connecting to the bottom reservoir 40 of the water heater. The hot water from the reservoir 56 is utilized to feed various apparatus in the institutional application and also feeds the heat exchanger 54 to heat water for a domestic water tank 57. Accordingly, the economizer water heater of the present invention is utilized at its maximum efficiency in a circuit combining it with various apparatus where heat can be recovered, and where the heated water from the water heater 10 can be utilized to feed various devices and some of which is recirculated back into the water heater for heating to a higher temperature. The flue gases exiting the water heater have been cooled down to a temperature of about 50° F. with the water in the reservoir having been heated to about 140° F.

It is within the ambit of the present invention to cover any obvious modifications, provided such modifications fall within the scope of the appended claims.

The embodiments of the invention in which an exclusive property or privilege is claimed are defined as follows:

1. A direct contact water heater having a hybrid heat source, said water heater comprising an elongated vertical tubular housing having a water spray nozzle in an upper end thereof for spraying water downwardly on a top packing of heat exchange bodies held in a region of said housing by support means, an exhaust gas flue communicating with said upper end, an intermediate space in said housing below said top packing, a hot recovery gas inlet in a wall of said housing and communicating with said intermediate space to admit a flow of secondary heat in said housing, a burner chamber below said hot gas inlet, a burner connected to said burner chamber for generating a flame in said burner chamber to form a primary heat source and together with said secondary heat constituting said hybrid heat source, said water sprayed on said top packing being firstly heated by hot gases from said hybrid heat source rising from said top packing and then being further heated by said heat exchange bodies where water propagates and falls in droplets by gravity from a lower surface of said top packing and further heated by contact with said rising heat below said top packing and said flame in said burner chamber, said heated water accumulating in a lower reservoir where it is transferred by a pump circuit connected thereto.

2. A water heater as claimed in claim 1 wherein a lower packing of heat exchange bodies is held by further support means between said intermediate space and said burner chamber to provide a longer contact time with said hot gases of water propagating down said housing.

3. A water heater as claimed in claim 2 wherein a cooling hollow circumferential chamber having a circulating cooling liquid therein is provided about said combustion camber and extending thereabove a predetermined distance to protect said combustion housing from excessive heat generated by said flame.

4. A water heater as claimed in claim 3 wherein said cooling hollow circumferential chamber is formed by a tubular casing disposed inside said tubular housing and spaced from a lower side wall section of said burner chamber and terminating above said lower packing, a circumferential open top end between said tubular casing and tubular housing, a cooling water inlet connected to said chamber for feeding cooling water thereto and circulating same in said chamber and causing overflow from said open top end and onto said lower packing.

5. A water heater as claimed in claim 4 wherein said further support means comprises hollow tubular support bars extending across said tubular casing and having a hollow through bore therein communicating with said annular cooling chamber whereby said cooling water will flow through said hollow through bore to cool said bars.

6. A water heater as claimed in claim 5 wherein a heat-resistant metal screen is supported on said tubular support members and constitutes said further support means.

7. A water heater as claimed in claim 2 wherein said support means is a heat-resistant metal screen supported across said tubular housing.

8. A water heater as claimed in claim 2 wherein said tubular housing is a cylindrical housing of circular cross-section, said exhaust gas flue being disposed about the central longitudinal axis of said housing at a top end thereof, said water spray nozzle being disposed below said exhaust gas flue end aligned on said central longitudinal axis to distribute a water spray substantially evenly over said top packing.

9. A water heater as claimed in claim 2 wherein said heat exchange bodies of said top and lower packings are hollow shaped metallic bodies.

10. A water heater as claimed in claim 1 wherein said hot gas inlet is connected to one or more heat sources generated by external heat generating devices connected in a heat recovery system associated with said water heater.

11. A water heater as claimed in claim 2 wherein said intermediate space constitutes a flue gas mixing chamber for mixing hot gas from said primary heat source with said secondary heat from said hot gas inlet, said secondary heat being fed to said intermediate space at a pressure sufficient to prevent a return heat flow through said hot gas inlet.

12. A method of heating water in a direct contact water heater column comprising the steps of:

i) providing a packing of heat exchange bodies across an inner space of said column in a top portion thereof;

ii) spraying water substantially uniformly over said packing so that said water percolates in droplets down said inner space of said column to a lower reservoir;

iii) generating heat in said column from a primary heat source in the housing whereby heat will rise therealong and exit at a top end of said column, said heat being displaced in counter-current to said percolating water droplets and heating said heat exchange bodies of said packings;

iv) admitting secondary heat in said housing from an external source, said secondary heat being introduced between said packing and said primary heat source; and v) pumping heated water from said lower reservoir.

13. A method as claimed in claim 12 wherein there are two spaced apart packings in said column, said step (iv) comprises feeding hot gas from an outside recovery heat source into an intermediate chamber defined by a space between said packings, and providing a primary heat source from a burner connected to a burner chamber below a lower one of said packings above said lower reservoir, said primary and outside recovery heat source mixing in said intermediate chamber to form a hybrid heat source which propagates through a top one of said packings.

14. A method as claimed in claim 13 wherein there is further provided the step of:

(vi) overflowing water on said lower one of said packings from a cooling chamber provided about said burner chamber to further warm cooling water admitted in said cooling chamber where it is heated.

15. A method as claimed in claim 13 wherein there is provided the step of:

(vii) overflowing water around a cylindrical top opening of said cooling chamber onto said heat exchange bodies of said lower packing where said overflow of water is broken down in droplets by the shape of said heat exchange bodies, said overflow of water being heated by heat exchange with said heat exchange bodies and by contact with said flame and heat rising therefrom in said combustion chamber.

* * * * *